United States Patent [19]

Katoh et al.

[11] Patent Number: 4,917,641

[45] Date of Patent: Apr. 17, 1990

[54] LIFE JACKET

[76] Inventors: Shoji Katoh, 90, Hakuraku, Kanagawa-ku, Yokohama; Minoru Arai, 146-3, Isezakicho 6-chome, Naka-ku, Yokohama, both of Japan

[21] Appl. No.: 383,307

[22] Filed: Jul. 18, 1989

Related U.S. Application Data

[63] Continuation of Ser. No. 179,103, Apr. 8, 1988, abandoned.

[30] Foreign Application Priority Data

Mar. 8, 1988 [JP] Japan ..... 63-30667[U]

[51] Int. Cl.[4] ..... B63C 9/08

[52] U.S. Cl. ..... 441/115

[58] Field of Search ..... 441/102, 103, 104, 106–119

[56] References Cited

U.S. PATENT DOCUMENTS

| | | | |
|---|---|---|---|
| 1,077,868 | 11/1913 | Berman | 441/107 |
| 3,199,128 | 8/1965 | Nojd | 441/92 |
| 4,416,641 | 11/1983 | Spinosa et al. | 441/107 |

FOREIGN PATENT DOCUMENTS

| | | | |
|---|---|---|---|
| 1111714 | 11/1981 | Canada | 441/107 |
| 2059360 | 4/1981 | United Kingdom | 441/107 |

*Primary Examiner*—Joseph F. Peters, Jr.
*Assistant Examiner*—Jesus D. Sotelo
*Attorney, Agent, or Firm*—Jordan and Hamburg

[57] ABSTRACT

A lined life-jacket comprises an airtight inflatable bag extending along the front and along the area of the neck and shoulders, a device for supplying compressed air into the airtight bag and an inflation tube. The compressed air supply device and the inflation tube are so arranged on the life-jacket that a person wearing the life-jacket can easily operate the device by hand and easily place the tube in the wearer's mouth.

3 Claims, 2 Drawing Sheets

LIFE JACKET

This application is a continuation of application Ser. No. 179,103, filed Apr. 8, 1988 now abandoned.

BACKGROUND OF THE INVENTION

The present invention relates to a life-jacket suitable for wearing when enjoying fishing and other marine sports.

Such a life-jacket has been in use and has been made of a water-proof cloth such as nylon and which inflated when filled with compressed air if a person wearing it pulled an actuating string in an emergency. There may have been further modifications like life-jackets filled with styro foam or other suitable materials used to increase their buoyancy. They were designed for emergencies and have the disadvantage of being uncomfortable to wear and not sufficiently warm.

SUMMARY OF THE INVENTION

The object of the present invention is to provide a safe and warm life-jacket which is, of course, used as a life saving device suitable to wear when enjoying offshore fishing, yachting and other marine sports and, furthermore, can be used as leisure wear.

It is another object of the present invention to provide a safe and warm life-jacket having an airtight bag which can be instantly inflated with compressed air from a cylinder in case of an emergency and also can be inflated through the use of an inflation tube without the use of the cylinder when enjoying marine sports.

It is another object of the present invention to provide a safe and warm life-jacket having an airtight bag which forms an air pillow around the wearer's neck and a safety cushion around the neck and chest when the bag is inflated.

It is another object of the present invention to provide a safe and warm life-jacket which can be fixed to the wearer's body by the use of a belt to eliminate the possibility of its slipping off in the case of an emergency.

DESCRIPTION OF THE PREFERRED EMBODIMENTS

To realize the above-mentioned object, the present invention provides a lined life-jacket which has an airtight inflatable bag extending along the front and along the area of the neck and shoulders along with an external device for supplying compressed air into the airtight inflatable bag and an inflation tube. The present invention is characterized in that the compressed air supply device and the inflation tube are located at positions allowing the wearer to easily operate the device by hand and to easily take the tube end into the wearer's mouth. The whole of the life-jacket is filled with feathers to increase its capacity for warmth. Furthermore, to prevent the life-jacket from sliding off the wearer's body when the wearer falls into water, the life-jacket is provided with belts having at least one free end to be secured to the body.

Figure 1:
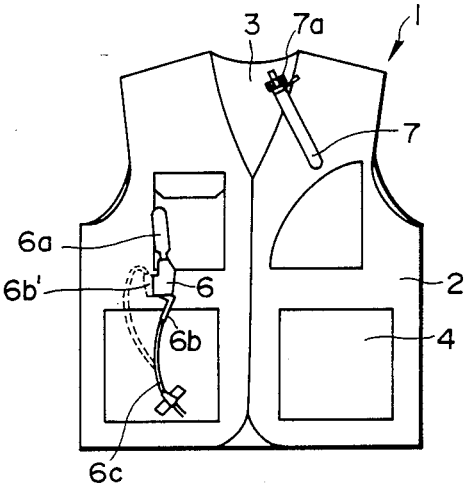
FIG. 1 is a front view of a life-jacket embodying the present invention.
Figure 2:
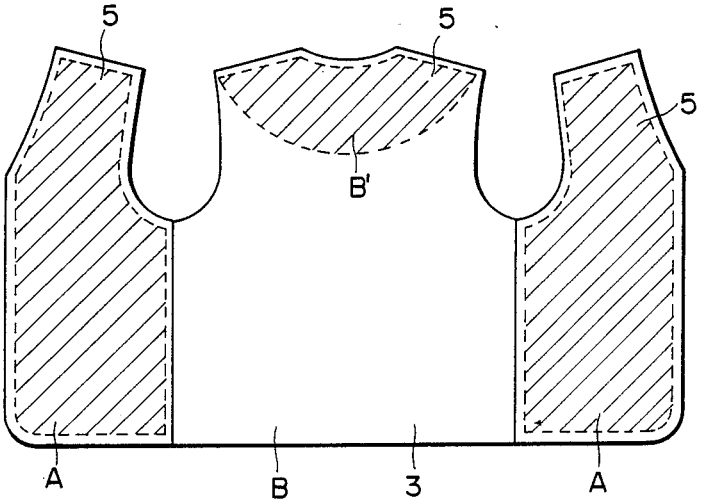
FIG. 2 is an inside view of the life-jacket seen in FIG. 1.
Figure 3:
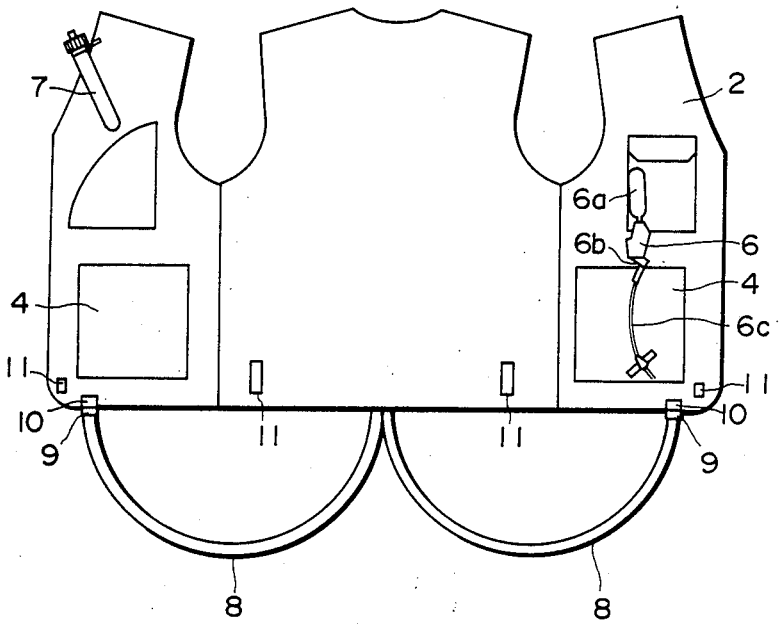
FIG. 3 is an outer view of a life-jacket according to a further embodiment of the present invention.

FIG. 1 is a front view of the life-jacket according to a preferred embodiment of the present invention. FIG. 2 is the inner (lining side) portion of the life-jacket shown in FIG. 1. FIG. 3 is the outer portion of the life-jacket showing a further embodiment of the invention. In these drawings, a life-jacket 1 comprises an outer cloth 2 sewed with a lining 3 and having any quantity of pockets 4 at positions on its outside and/or inside and incorporating an airtight inflatable bag 5 (shown by the broken lines in FIG. 2). In this embodiment, an airtight inflatable bag 5, as shown in FIG. 2, stretches to the left and right front sides A and the neck-and-shoulder Part B′ of the back side B of the life-jacket. These parts of the airtight inflatable bag are attached to each other. Feathers (not shown) are provided as filling between the bag 5 and the lining 3 of the life-jacket. A compressed air-supplying device 6 comprises a compressed air cylinder **6*a*, an actuating lever 6*b* and an actuating string 6*c*. The actuating lever 6*b*′ is usually placed in a position 6*b*′ shown by the dotted line in FIG. 1 and, when the actuating string is pulled in an emergency, it moves to a position shown by the solid line to break the seal of the cylinder 6*a* to fill the airtight inflatable bag 5 with compressed air. The used cylinder can be exchanged for a new one. One end of an inflation tube 7 is connected to the airtight inflatable bag 5 in the life-jacket through the outer cloth 2 and the other end is left free at a position where the wearer can easily take it into the mouth. In usual practice, a person wearing the life-jacket removes a cap 7*a* and holds the free and of the inflation tube 7 in the mouth to inflate the airtight inflatable bag 5** and, after its use, exhausts air from the bag by manually pressing a check valve mounted in the inflation tube end.

In FIG. 3, two belts 8 are provided, each of them having one end sewed near the center of the back B and the other free end provided with a securing device 9 for fixing to a securing part 10 provided at a suitable position on the front A of the life-jacket 1. Belt loops 11 are provided for holding the corresponding belts 8 when the belts are not being used for fixing the life-jacket to the wearer's body. The right and left front parts of the life-jacket are fastened to each other by a suitable device (not shown).

The above-mentioned compressed air supply device 6 and the inflation tube, excepting the device actuating string and the tube end, may be sewed in pocket 4 and under the outer cloth 2 to make them invisible from the outside.

The life-jacket 1 according to the present invention can be instantly inflated with compressed air from the cylinder **6*a* by pulling the actuating string 6*c*. To prevent the life-jacket 1 from slipping off in case of an emergency, the life-jacket can be fixed to the wearer's body by placing the free ends of two belts 8** between the legs and by securing them to the front of the life-jacket.

The life-jacket, according to the present invention, is mainly used when enjoying seaside and offshore fishing, yachting or even mountaineering. Usually, the inflatable bag 5 in the life-jacket is filled with air by blowing through an air inflating tube 7, but in an emergency such as falling over a craggy cliff or overboard from a yacht it is instantly filled with compressed air from the cylinder **6*a* by pulling the actuating string 6*c***.

In case of using the life-jacket as town wear it is recommended that the belts be passed through the belt loops provided. Although only embodiments in the form of sleeveless-type life-jackets have been shown and described, it is apparent that other embodiments such as those having long or short sleeves and modifications in size and neck-line shapes are possible.

According to the present invention, an airtight bag in a life-jacket, as stated above, can be instantly inflated with compressed air from a cylinder in case of an emergency and also can be inflated through the use of an inflation tube without the use of the cylinder when enjoying marine sports. When the airtight bag in the life-jacket is inflated, it forms an air pillow around the wearer's neck and a safety cushion around the neck and chest. Warmth is provided by the feather filling in whole or part of the life-jacket. Furthermore, the life-jacket can be fixed to the wearer's body by the use of a belt to eliminate the possibility of its slipping off in the case of an emergency.

We claim:

1. A life-jacket comprising an outer cloth and an inner lining, said outer cloth and said inner lining being joined to one another to define therebetween a back part enclosure and two front part enclosures with each of said front part enclosures being joined to said back part enclosure, said back part enclosure having an upper portion adapted to be juxtaposed to a wearer's neck and shoulders when the life-jacket is placed on a wearer's body ready for use, air-inflatable bag means disposed within each of said front part enclosures and in said upper portion of said back part enclosure, feathers in each of said front part enclosures and in said upper portion of said back part enclosure between said air-inflatable bag means and said inner lining, said outer cloth having a pocket, compressed air means on said life-jacket disposed in said pocket, actuating means connected to said compressed air means and actuated by said wearer to admit compressed air from said compressed air means to said air-inflatable bag means to inflate the latter, an inflation tube means mounted on said life-jacket and receivable in said wearer's mouth for the wearer to blow air into said air-inflatable bag means to inflate the latter, said actuating means being disposed on said life-jacket so as to be readily actuated by said wearer when the life-jacket is placed on a wearer's body ready for use, said inflation tube means being disposed on said life-jacket so as to be readily receivable in said wearer's mouth when the life-jacket is placed on a wearer's body ready for use, each of said two front part enclosures and said back part enclosure having a lower edge portion, two belt means, securing means securing one end of each of said two belt means to each lower edge portion of said two front part enclosures, said two belt means each passing between said wearer's legs and being secured to said lower edge portion of said back part enclosure, and loop means on said lower portion of each of said front part enclosures and on said lower portion of said back part enclosure for holding said two belt means when said two belt means are not being used to secure the life-jacket to a wearer's body.

2. A life-jacket according to claim 1, further comprising a manually operated check valve in said inflation tube means which is manually operable by said wearer to exhaust air from said air-inflatable bag means.

3. A life-jacket according to claim 1, wherein said inflation tube means has a tube end adapted to be received in said wearer's mouth, the remainder of said inflation tube means being juxtaposed to said inner lining so as not to be visible when the life-jacket is placed on a wearer's body ready for use.

* * * * *